United States Patent [19]

O'Brien et al.

[11] Patent Number: 4,597,749

[45] Date of Patent: Jul. 1, 1986

[54] THERMOPLASTIC BAG HAVING REINFORCED HANDLES AND METHOD OF MANUFACTURE

[75] Inventors: Dennis O'Brien, Rochester; Graham Smith, Walworth, both of N.Y.

[73] Assignee: Mobil Oil Corporation, New York, N.Y.

[21] Appl. No.: 748,699

[22] Filed: Jun. 25, 1985

Related U.S. Application Data

[62] Division of Ser. No. 571,177, Jan. 16, 1984, abandoned.

[51] Int. Cl.[4] ..... B31B 1/86

[52] U.S. Cl. ..... 493/226; 156/204; 383/8; 493/248; 493/264; 493/926

[58] Field of Search ..... 493/193, 194, 199, 226, 493/231, 243, 248, 251, 264; 383/8–10; 186/204, 226, 227

[56] References Cited

U.S. PATENT DOCUMENTS

| | | | |
|---|---|---|---|
| 3,070,278 | 12/1962 | Korn | 383/9 |
| 3,154,238 | 10/1964 | Barnhill | 383/20 |
| 3,180,557 | 4/1965 | Thulin | 383/8 |
| 3,255,951 | 6/1966 | Kay | 383/10 |
| 3,352,411 | 11/1967 | Schwarzkopf | 383/8 |
| 3,454,441 | 7/1969 | Spruyt | 383/10 |
| 3,468,470 | 9/1969 | Sengewald | 383/10 |
| 3,482,761 | 12/1969 | Suominen et al. | 383/8 |
| 3,797,733 | 3/1974 | Ibing | 383/10 |
| 4,085,822 | 4/1978 | Osborn | 186/66 |
| 4,125,220 | 11/1978 | Suominen | 383/9 |
| 4,346,834 | 8/1982 | Mazumdar | 383/8 |
| 4,464,157 | 8/1984 | Benoit et al. | 493/226 |

FOREIGN PATENT DOCUMENTS

| | | | |
|---|---|---|---|
| 405057 | 7/1966 | Switzerland | 383/8 |
| 1071296 | 6/1967 | United Kingdom | 383/18 |
| 1465695 | 2/1977 | United Kingdom | 383/8 |

*Primary Examiner*—Francis S. Husar
*Assistant Examiner*—Robert Showalter
*Attorney, Agent, or Firm*—Alexander J. McKillop; Michael G. Gilman; Charles J. Speciale

[57] ABSTRACT

The present invention relates to a thermoplastic bag which is characterized by having a pair of carrying handles formed integrally with the bag walls and extending upwardly from opposite sides of an open mouth portion of the bag. The handle members are reinforced and comprise at least two layers of thermoplastic material, one of the layers forming the bag body and handles and the other layer serving as a reinforcement layer. The reinforcement layer is provided only in the handle areas of the bag structure.

12 Claims, 15 Drawing Figures

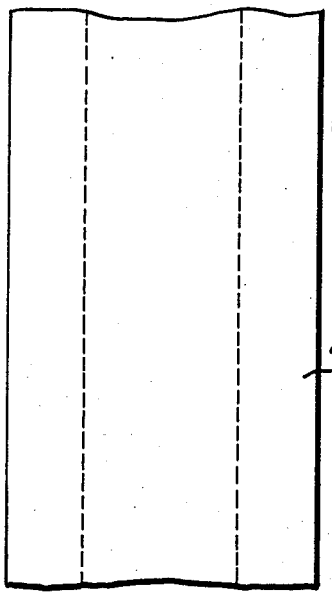
Figure 2
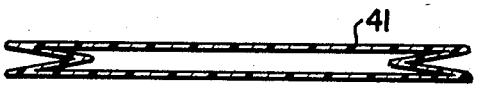
Figure 3
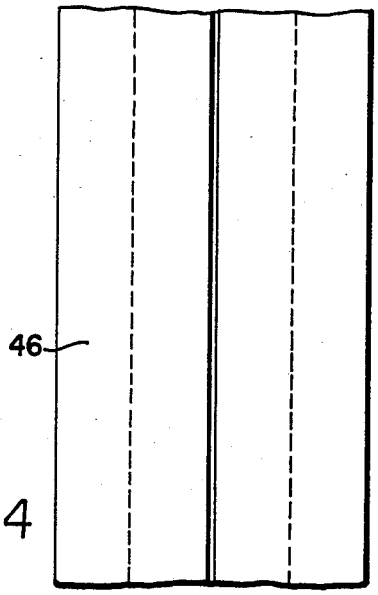
Figure 4
Figure 5
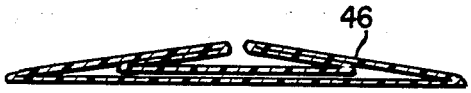
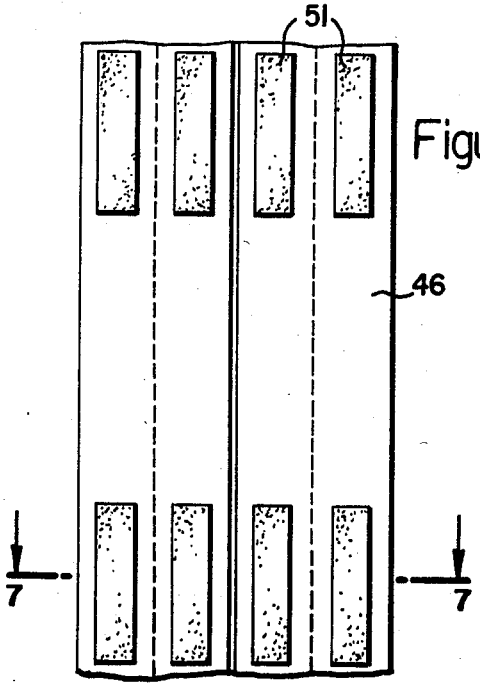
Figure 6
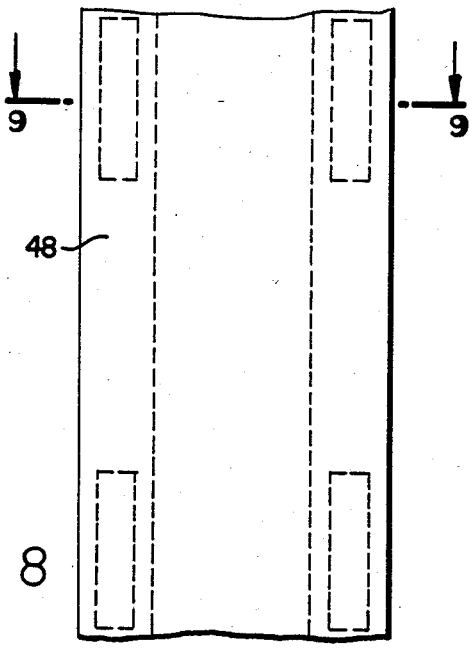
Figure 8

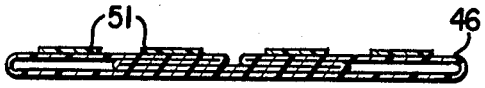
Figure 7
Figure 9
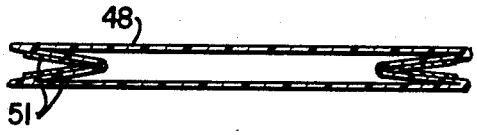
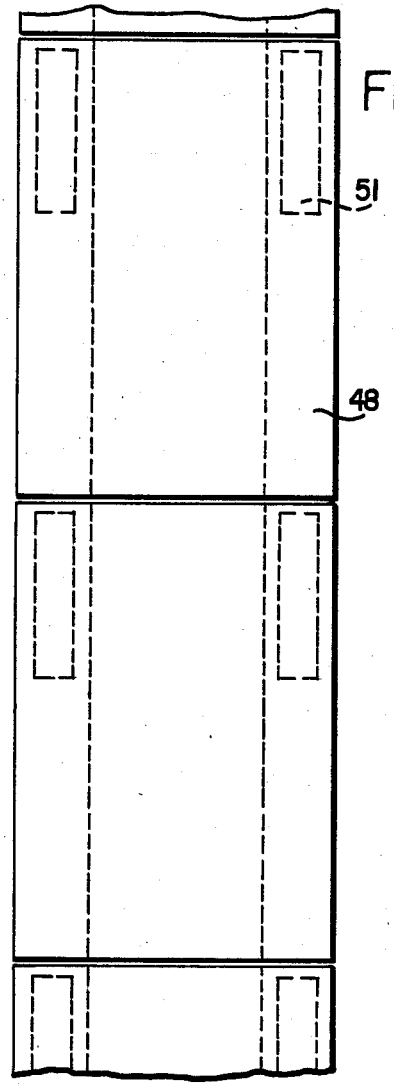
Figure 10
Figure 11
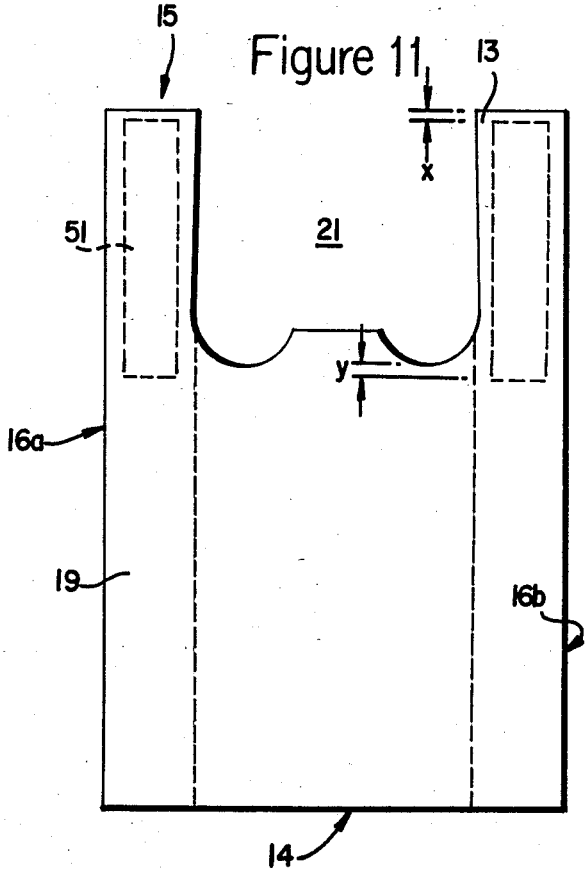

THERMOPLASTIC BAG HAVING REINFORCED HANDLES AND METHOD OF MANUFACTURE

This application is a division of application Ser. No. 571,177, filed Jan. 16, 1984, now abandoned.

BACKGROUND OF THE INVENTION

1. Field of the Invention

The present invention relates to thermoplastic bags which are provided with integral handle members on opposite sides of the bag mouth and, more particularly such thermoplastic bags having an additional thermoplastic reinforcement in the handle area.

2. Description of the Prior Art

In the past, bags which were characterized by having carrying handles thereon were constructed using separate handle elements, distinct from the bag structure itself. Such handle elements were individually fed, during bag manufacture, for attachment adjacent to the open mouth portion of the bag. The manufacturing operation to produce such prior art structures with the separate process step of supplying handle elements, and applying them to the bag, is quite cumbersome and uneconomical.

More recently, however, bag structures have been developed, see for example, U.S. Pat. Nos. 4,085,822; 3,352,411; and 3,180,557; and Belgian Pat. No. 862,069, the disclosures of which are incorporated herein by reference, wherein the bags are formed so that the handle carrying elements are formed as an integral part of the bag structure itself. That is, the handles are actually an extension of the bag walls. An example of such a bag structure is one that is constructed from a flattened tube or a flattened side edge gusseted tube which is sealed at both ends. A flattened end portion of such a tube is cut off to form an open mouth bag having handles on either side thereof. Conversely, such a bag may be formed by folding a piece of the thermoplastic material on itself, the bottom fold line constituting the bottom part of the bag and heat sealing the upper edge and side wall parts of the bag together. Next, a U-shaped cutout is made in the upper portion of the bag to provide an opening or entrance for the introduction of goods to be packaged. The opposite edges of the upper portion of the bag structure immediately adjacent to the cutout area form loops which may be used to carry such bag structures when they are loaded, i.e., double ply thickness, by virtue of the presence of the re-entrant or gusset fold in the loop handle members.

These prior art bag structures present difficulties for the end user, particularly since, for reasons of economy, such structures are usually produced from extremely thin thermoplastic material, i.e., on the order of about 1.0 mil or less. There is a tendency for such bags to fail in the handle area where, when the loaded bags are being carried, there is a tendency for the stress forces to concentrate. Prior art bag structures of the type hereinabove described are usually formed from low-density polyethylene material.

It has been found that the use of a mono-layer homogeneous composition for both the handle and the body portion of the hereinabove described bags requires necessarily that the resin and thickness choice fulfill the handle tensile strength requirements and body tear and puncture requirements simultaneously. Obviously, such an arrangement is not the most economical utilization of available resin materials. Generally speaking, a single specialty resin which would accomplish all three of these requirements, when produced in the form of a relatively thin film structure, would be economically prohibitive in the case of the manufacture of the present disposable bag structures.

In general, low density polyethylene has certain physical characteristics which make its employment as a body film desirable for the handle bag constructions of the present invention. In particular, such advantages include its low cost, high puncture resistance, and its resistance to splitting and tearing while under load stress. Conversely, however, as hereinabove noted, low density polyethylene exhibits unsatisfactorily low load bearing ability in the handle regions. The relative low tensile yield properties of low density polyethylene account in part for this deficiency. To increase handle strength, it has been proposed, in application Ser. No. 086,374, filed Oct. 18, 1979, discussed above, to reinforce the handles of the bags with reinforcement films which are laminated to the bag and extend from a top to a bottom edge thereof.

The reinforcement film is specifically designed to improve the overall tensile yield and strength characteristics of the bag in the handle. Materials which can be used for the reinforcement film include fractional melt index low-density polyethylene, and other thermoplastic materials, such as linear low-density polyethylene, polypropylene, high-density polyethylene, and thermoplastic films which are highly oriented in the machine direction, including film materials which have been cold drawn, i.e., stretched, at ambient temperatures. In addition to cold drawing techniques to achieve the requisite strength characteristics for the reinforcing handle film, the reinforcement film may also be melted oriented during extrusion. In the case of high-density polyethylene, such melt orientation may be achieved during tubular extrusion thereof by employing low blow-up ratios on the order of about 2:1. A range of such low blow-up ratios which may be employed to achieve melt orientation of high density polyethylene encompasses from about 1:1 up to about 2.5:1. It has been found that the employment of oriented handle laminating materials in the bag handle area result in improvements in both tensile strength and the yield strength of the film.

Although the reinforcement films employed provide a considerable increase in handle strength, they extend to areas of the bag where reinforcement is not required, thereby wasting resin and adding to overall bag cost.

In addition, during bag construction, heat sealing is employed at areas defining the top and bottom edges of the bag. This heat sealing occurs along a bag edge which has thinner areas defined by the bag film alone and thicker areas defined by gussets in the bag film and by the lamination of the bag film and the reinforcement film. Heat sealing across the bag edge becomes difficult because of the different material thickness. An optimal temperature and dwell time for heat sealing through one thickness will not be the optimal conditions for heat sealing through the other. As a result, a compromise temperature and dwell time must be used which is not optimal for either of the material thicknesses. The heat sealing problem can be further aggrevated if different polymers are used for the bag body and reinforcement film.

SUMMARY OF THE INVENTION

In accordance with one aspect of the present invention, handled thermoplastic bag structures are formed wherein the individual handles of such bags are reinforced by the lamination in the handle areas of another relatively thin film segment or patch, which will impart the required tensile strength, tear resistance, and puncture resistance in combination with the bag proper, which is necessary to ensure the required structural integrity of such bag structures when they are under load stress. The reinforcement patches are applied only in the handle areas where reinforcement is required, thereby reducing the amount of polymer required to reinforce the handle areas of the bag structure and lowering the overall bag cost.

In particular, specific embodiments of the bag structures of the present invention, the handle areas of the bag may be reinforced by the lamination thereto of a reinforcement patch using, for example, an adhesive resin lamination, whereby the reinforced handle patches are applied to a preformed body film with an intermediate layer of adhesive.

The reinforcement patches are also applied in areas of the bag handles which are below a top heat sealed edge of the bag so that heat sealing does not occur through the reinforcement patches, thereby reducing problems incidental to heat sealing through different material thicknesses and/or through different materials.

The above-described objects, advantages and features of the invention will become more apparent from the following detailed description of the invention, which is provided in connection with the accompanying drawings.

BRIEF DESCRIPTION OF THE DRAWINGS

FIG. 2 is a side elevational view of a gusseted film used in the FIG. 1 apparatus;

FIG. 3 is a cross-sectional view of the FIG. 2 film;

FIG. 4 is a side elevational view of an unfolded gusseted film formed by the FIG. 1 apparatus;

FIG. 5 is a cross-sectional view of the FIG. 4 film;

FIG. 6 is a side elevational view of an unfolded gusseted film, with film patches applied thereto by the FIG. 1 apparatus;

FIG. 7 is a cross-sectional view along the lines 7—7 in FIG. 6;

FIG. 8 is a side elevational view of a refolded gusseted film formed by the FIG. 1 apparatus;

FIG. 9 is a cross-sectional view along the line 9—9 in FIG. 8;

FIG. 10 is a side elevational view illustrating fim severance which occurs during bag formation;

FIG. 11 is a side elevational view of a completed bag having reinforcement film patches in the handle area;

DESCRIPTION OF SPECIFIC EMBODIMENTS

Figure 1:
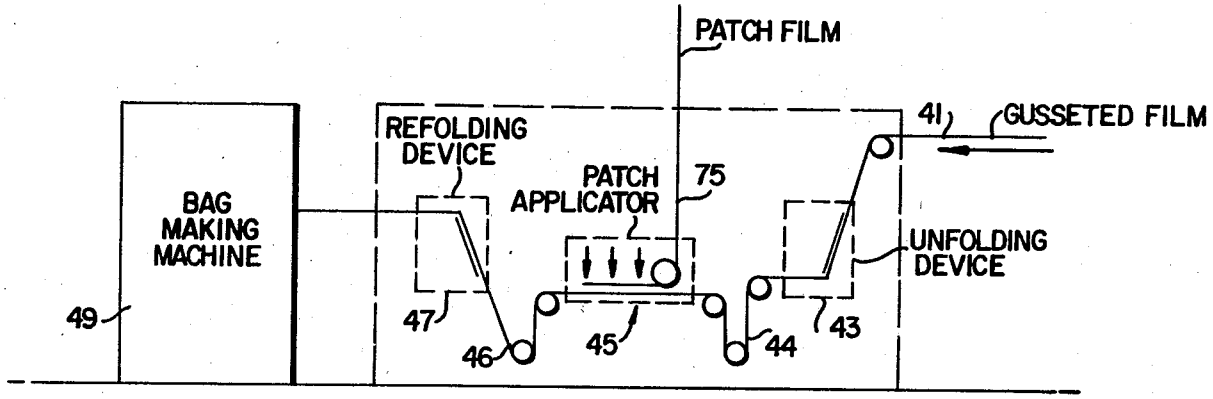
FIG. 1 is a schematic side view of an apparatus for forming bags having reinforcing film patches in the handle areas.

FIG. 11 shows a preferred basic form of a bag structure, which is improved and strengthened by the practice of the present invention. The bag is fabricated from a gusseted, flattened thermoplastic tube. It comprises integral upper handle members 13 which are heat sealed along their upper edges at 15. The bag bottom portion is also sealed along the area designated as 14. The opposite side edges 16*a*, 16*b* of the bag structure are characterized by having inwardly folded gusset pleats 19, which allow for bag expansion during loading, and provide a double ply thickness to assist in reinforcement and strengthening of bag handle members 13. Also, as shown in FIG. 11, the upper portion of the bag structure is cut away to form a bag mouth opening 21.

As further shown in FIG. 11, reinforcement patches 51 in the form of strips are provided in the handle member 13 areas. The reinforcement strips 51 extend from an area adjacent edge 15, e.g., approximately ¼" below edge 15, to below the lowermost portion of mouth opening 21, e.g., approximately 1" below the lowermost portion of mouth opening 21. The reinforcement strips 51 serve to strengthen the handle members 13 which minimizing polymer required for the reinforcement. Heat sealing at the top and bottom edges is also facilitated as a single thickness of body film extends across the top 15 and bottom 14 edges.

A method and apparatus for forming the FIG. 11 bag structure will now be described with reference to FIGS. 1–15.

Figure 12:
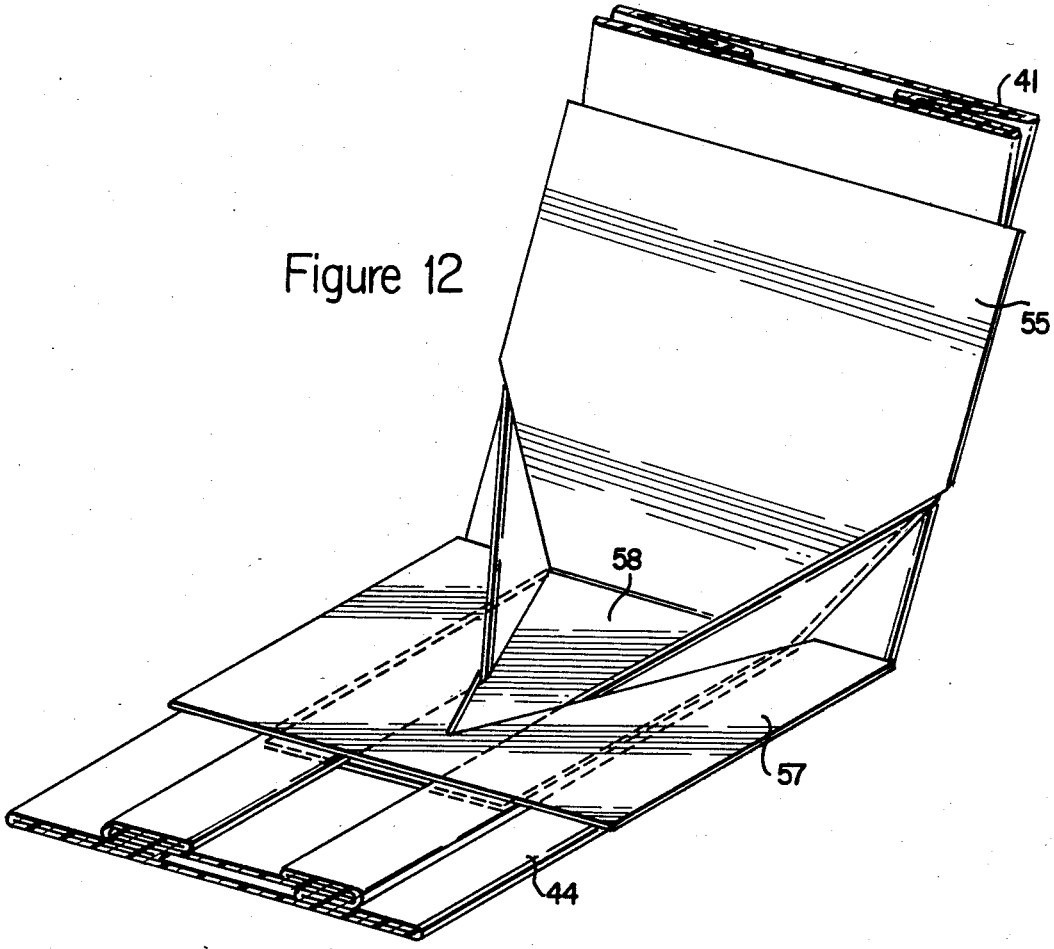
FIG. 12 is a perspective view of the unfolding device illustrated in FIG. 1.
Figure 13:
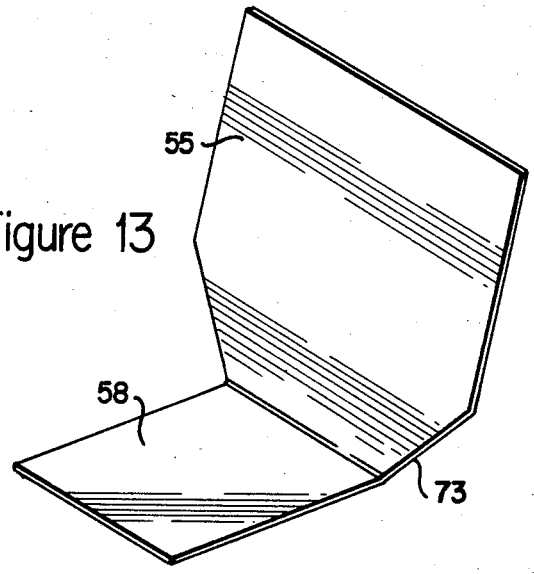
FIG. 13 is a perspective view of a first portion of the unfolding device.
Figure 14:
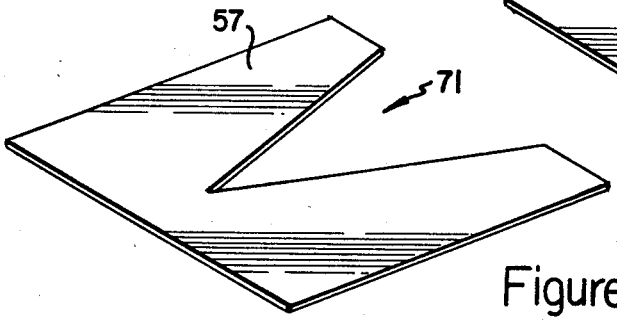
FIG. 14 is a perspective view of a second portion of the unfolding device.

The overall process and apparatus for applying the reinforcing patches is illustrated in FIG. 1. A continuous flattened gusseted tubular film 41 of the construction shown in FIGS. 2 and 3 advances to an unfolding device 43, which unfolds one of the gusset flaps on each side of the film 41. The unfolding device is illustrated in detail in FIGS. 12–14. It includes a first unfolding board 55 (FIG. 13) and a second unfolding board 57 (FIG. 14). The second unfolding board 57 contains a V-shaped cutout 71 and resides over a bottom portion 58 of the first unfolding board 55, with the gusseted film 41 passing behind and underneath the first folding board 55. The gusseted flaps are opened by the cooperation of inclined sides 73 of the first folding board and the V-shaped opening 71 in the second folding board 57, in the manner illustrated in FIG. 12. The unfolded film is illustrated in FIGS. 12, 5 and 6. The unfolded film 44 then passes through a patch applicator station 45, which receives a continuous reinforcing patch film 75. Patch applicator station 45 both severs film 75 into patch film segments 51 and also applies the patch films 51 to the unfolded film 44, in the locations illustrated in FIGS. 6 and 7.

Figure 15:
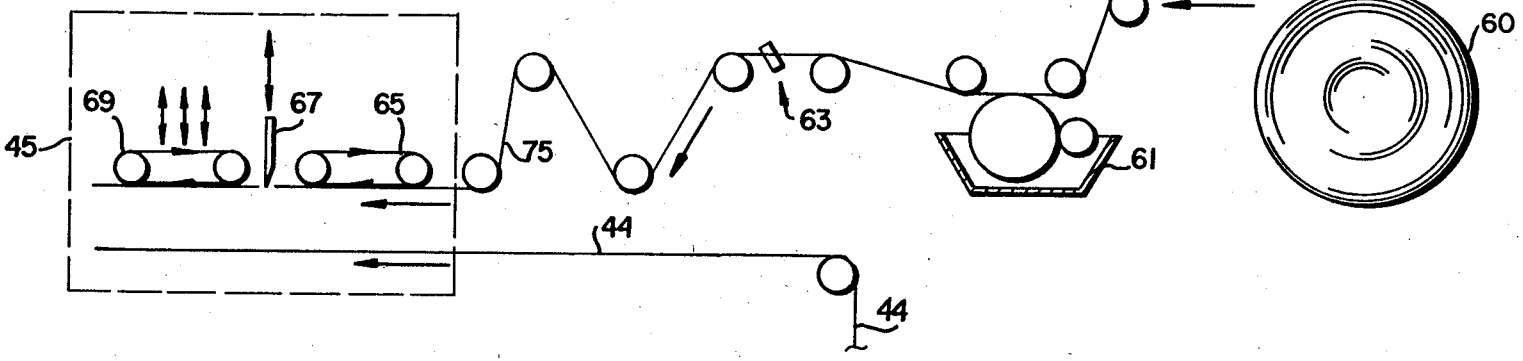
FIG. 15 is a schematic side view of an apparatus for forming reinforcement film patches.

The manner in which the patch film segments 51 are formed is illustrated in greater detail in FIG. 15. A continuous flat sheet-like patch film 59 advances from a supply roll 60 to an adhesive application station 61, wherein an adhesive is applied to one side thereof. The sheet-like film then advances to a slitting station 63 where the film is slit and separated into four patch film strips, which are widthwise spaced apart and located to overlie the unfolded flaps in the locations illustrated in FIGS. 6 and 7. The four patch film strips then advance to the patch applicator 45 where they are severed into patch film segments 51 by a reciprocating knife 67 and applied to the advancing unfolded film 44 by a reciprocating conveyor 69. Upon leaving the patch applicator 45, the reinforced unfolded film 46 has the construction illustrated in FIGS. 6 and 7. The unfolded film is now refolded by refolding device 48, which is simply folding device 43 operating in an inverse manner to the operation illustrated in FIG. 12, that is with the unfolded film traveling in a reverse direction to the film traveling direction of FIG. 18. After refolding, the advancing film 48 assumes the construction illustrated in FIGS. 8 and 9. The refolded and reinforced film 48 then advances to a conventional bag-making machine 49, which severs the advancing film into segments, as shown in FIG. 10, heat seals the top and bottom edges of the severed film segments, and then cuts a bag mouth opening 21. The completed bag, having reinforcing film patches 51 in the handle areas, is that illustrated in FIG. 11.

The tops of the reinforcing patches 51 are preferably located at some distance "x", e.g., approximately ¼", below the heat sealed upper bag edge, and the bottom of the reinforcing patches preferably extends a distance "y", e.g., greater than 1" and preferably in the range of 1–3", below the bottom of the cutout which forms the bag opening. This location provides several advantages. By spacing the top edge of the reinforcement patch 51 away from the top edge of the bag, optimal heat sealing along the top edge can occur. In addition, extending the lower part of the sealing strips below the lowest point of the bag opening cutout and above the bag bottom assures adequate distribution of tensile forces and thus proper handle member reinforcement, while minimizing the polymer required for the reinforcing patches 51.

A bag produced in accordance with the invention has good puncture and tear resistance in its body by virtue of the polymer used therein. The reinforcing patches 51 applied to the handle areas increase the bag tensile strength thereat. The polymer used for the bag film may be the same or different from the polymer used for the reinforcement strips. The reinforcement strips may be constructed of the same materials as discussed above for the reinforcement film used in application Ser. No. 086,374. The reinforcement may also be constructed of polymer having a high tensile strength than the polymer used for the bag body film.

EXAMPLE I

Bags having the configuration shown in FIG. 11 can be constructed with a reduced gauge linear low density polyethylene forming the body portion and with reinforcing patches 51 formed of the same material. The polymer has the following properties:

TABLE I

| | |
|---|---|
| Melt Index (gsm/10 min) | 1.0 |
| Density | .93 |
| MD Yield (psi) | 2100 |
| MD Ultimate (psi) | 6300 |
| MD Elongation (%) | 700 |

MD = Machine Direction

By using a 0.5 mil film for the bag body and a 1 mil×2" wide reinforcing patch, handle strength equivalent to a bag constructed entirely of 1 mil material can be achieved, while reducing the average bag gauge to 0.57 mil, as shown below:

TABLE II

| | Monolayer Film Bag | Example I Bag |
|---|---|---|
| Average bag gauge | 1.0 | .57 |
| Handle Strength | | |
| Yield Strength (lb) | 16.8 | 16.8 |
| Ultimate Strength (lb) | 50.4 | 50.4 |

EXAMPLE II

By using a high density polyethylene for the reinforcement patch and a linear low density polyethylene for the bag body, a further average gauge reduction can be achieved, while obtaining an increased handle strength. The linear low density polyethylene used in the bag body and the high density polyethylene used in the reinforcement patches have the following characteristics:

TABLE III

| | LLDPE Body Film | HDPE Handle Film |
|---|---|---|
| Melt Index | 1.0 | .08 |
| Density (gm/cc) | .93 | .955 |
| MD Yield (psi) | 2100 | 4200 |
| MD Ultimate (psi) | 6300 | 10341 |
| MD Elongation (%) | 700 | 328 |

With this combination, the average bag gauge is 0.54 mils when a 0.5 mil LLDPE body is combined with a 0.6 mil handle patch. The strength properties of this bag combination are as follows:

TABLE IV

| | Monolayer Film Bag | Example 2 Bag |
|---|---|---|
| Average guage | 1.0 | .54 |
| Handle Strength | | |
| Yield Strength (lb) | 16.8 | 18.48 |
| Ultimate Strength (lb) | 50.4 | 51.4 |

Although the bag structure illustrated in FIG. 11 has the reinforcement strips inside the handles on the gusseted portions of the bag, it should be apparent that the reinforcement strips can also be provided on the outer surface of the handles, or on the inner surface of the handles or on the inner and outer handle surface.

Although the present invention has been described with reference to preferred embodiments, it is to be understood that modifications and variations may be resorted to, without departing from the spirit and scope of the invention. Accordingly, the invention is not limited by the foregoing description, but is only limited by the scope of the claims appended hereto.

We claim:

1. A method of forming a thermoplastic bag structure comprising the steps of:

advancing a flattened tubular plastic film having inwardly directed gussets on opposite side edges thereof to an unfolding station;

unfolding at said unfolding station a flap of sid flattened tubular plastic film for each of said gussets, said unfolded flaps being on the same side of said flattened tubular plastic film;

advancing said unfolded flattened tubular plastic film to a reinforcement strip application station and applying thereat reinforcing strips to flaps forming said gussets, said reinforcing strips being applied to areas of said plastic film which are to form handles of a completed bag;

refolding the flaps of said gussets;

severing said plastic film into segments;

heat sealing top and bottom edges of said segments; and cutting a mouth opening in a top portion of each said segment to form a bag having front and rear bag walls and handles on opposite sides of said mouth opening which are extensions of said front and rear walls and reinforced by said reinforcing strips.

2. A method as in claim 1, further comprising the step of applying said reinforcing strips by an adhesive.

3. A method as in claim 1, further comprising the step of forming said bag walls and handles and said reinforcement strips of a linear low density polyethylene film.

4. A method as in claim 3, further comprising the steps of forming said bag walls of a film having a thickness of approximately 0.5 mil and forming said reinforcement strips of a film having a thickness of approximately 1 mil.

5. A method as in claim 1, further comprising the steps of forming said bag walls and handles of a linear low density polyethylene film and forming said reinforcement strips of a high density polyethylene film.

6. A method as in claim 5, further comprising the steps of forming said bag walls of a film having a thickness of approximately 0.5 mil and forming said reinforcement strips of a film having a thickness of approximately 0.6 mil.

7. A method as in claim 1, further comprising the step of spacing said reinforcement strips from a top edge of the handles of said bag structure by an amount which is sufficient to allow heat sealing of said top edge without heat sealing through said reinforcement strips.

8. A method as in claim 7, further comprising the step of spacing said reinforcement strips from said top edge by approximately ¼".

9. A method as in claim 1, further comprising the step of extending said reinforcement strips just beyond said lowermost portion of said open mouth portion.

10. A method as in claim 8, further comprising the step of extending said reinforcement strips to greater than 1" below said lowermost portion of said open mouth portion.

11. A method as in claim 10, further comprising the step of extending said reinforced strips to a range of 1" to 3" below said lowermost portion.

12. A method as in claim 1, further comprising the step of forming the reinforcement strips of a polymer having as higher tensile strength than a polymer forming said front and rear bag walls.

* * * * *